US006230539B1

(12) United States Patent
Dickson et al.

(10) Patent No.: US 6,230,539 B1
(45) Date of Patent: May 15, 2001

(54) ULTRA PRECISION NET FORMING PROCESS EMPLOYING CONTROLLED PLASTIC DEFORMATION OF METALS AT ELEVATED TEMPERATURES

(75) Inventors: Jerry M. Dickson, Memphis, TN (US); William R. Baschnagel, Etna; Mark C. Bagley, Grafton, both of NH (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/389,626

(22) Filed: Sep. 3, 1999

(51) Int. Cl.[7] ..... B21J 1/06
(52) U.S. Cl. ..... 72/364; 72/342.7
(58) Field of Search ..... 72/342.7, 342.8, 72/342.92, 364

(56) References Cited

U.S. PATENT DOCUMENTS

| | | | | |
|---|---|---|---|---|
| 1,380,250 | * | 5/1921 | Reymond | 72/342.7 |
| 3,025,905 | * | 3/1962 | Haerr | 72/342.92 |
| 3,066,098 | * | 11/1962 | Nichols | 72/342.7 |
| 4,479,833 | * | 10/1984 | Gessinger et al. | 72/342.7 |
| 5,214,948 | | 6/1993 | Sanders et al. | 72/58 |

FOREIGN PATENT DOCUMENTS

| | | | | |
|---|---|---|---|---|
| 53-14877 | * | 12/1978 | (JP) | 72/342.7 |
| 6-114483 | * | 4/1994 | (JP) | 72/342.7 |

* cited by examiner

*Primary Examiner*—Lowell A. Larson
(74) *Attorney, Agent, or Firm*—Arthur H. Tischer; Freddie M. Bush

(57) ABSTRACT

An ultra precision net shape forming process is disclosed which can satisfy the requirements of MMW and sub-MMW components and sabots for small caliber armor piercing ammunition. The process is well suited to both moderate and high volume applications, and offers the potential for dramatically reducing piece part fabrication costs. The process involves closely controlled high temperature compression forming of metals with cycle times of the order of one minute or less, precise replication of all die features, and very low residual stresses. The ultra precision net shape forming cycle starts following insertion of the billet/blank into an open die. In the preheat phase the press is closed to preheat position where the billet/blank is enclosed in both halves of the die but no force is applied. Following preheat the part is formed employing displacement and force control to insure a fully formed part. After holding for a preset time at the peak force, the press is then commanded back to the loading position. The process has many of the attributes of conventional compression molding of plastics and is well suited to high volume, automated production of complex precision parts.

3 Claims, 2 Drawing Sheets

ULTRA PRECISION NET FORMING PROCESS EMPLOYING CONTROLLED PLASTIC DEFORMATION OF METALS AT ELEVATED TEMPERATURES

DEDICATORY CLAUSE

The invention described herein may be manufactured, used, and licensed by or for the Government for governmental purposes without the payment to us of any royalties thereon.

BACKGROUND OF THE INVENTION

Current techniques for fabrication of precision, close tolerance, metal components typically require multiple process steps to produce a finished part. Often this involves preliminary steps (e.g. stamping, casting, forging, etc.) to create a semi-formed blank followed by precision machining, electric discharge machining (EDM), grinding and/or polishing to complete the part. This multiple step process is costly in terms of material handling, special tooling and fixturing, and material wastage associated with finishing the part.

The fabrication of precision millimeter wave (MMW) length radio frequency components and sabots for small caliber armor piercing ammunition present particularly difficult problems. As a general rule size and tolerance requirements for RF components scale with wavelength. Allowable dimensional tolerances are reduced to approximately ±25 microns (0.001 inch) for frequencies above 40 GHz and ±13 microns (0.0005) for frequencies above 75 GHz. Development of increasingly compact, higher frequency microwave and sub-millimeter systems for smart munition guidance, automobile collision avoidance, and communication applications have created significant fabrication challenges, particularly in terms of achieving economical high volume production.

Sabots for small caliber armor piercing ammunition such as the 25 MM round are currently machined from 7075-T6 aluminum. Each sabot is comprised of three separate 120-degree segments. The dimensional tolerance for each pressure flank is ±0.0005 inches. The three 120-degree segments are milled to precise tolerances and are individually numbered and mated together. Secondary machining operations are necessary to manufacture a complete sabot from the mated segments. The positioning of each segment is not interchangeable and the required CNC machining is time consuming and costly.

Fabrication of MMW and sub-millimeter wavelength components and housings and sabots for small caliber armor piercing ammunition rely heavily on CNC machining, EDM and/or electro-forming techniques. While these techniques can provide technically adequate MMW components and sabots, they do so only at unacceptably high piece part costs. In addition these techniques are poorly suited for high volume applications. Furthermore, as new applications are developed for sub-millimeter technologies, these techniques will be less and less capable of satisfying all of the technical requirements.

Therefore there is a critical need for fabrication processes that are capable of producing components to the precision required for MMW and sub-millimeter applications and sabots for small caliber armor piercing ammunition. The new fabrication processes must be competitive with current techniques and be capable of scaling to high volume production while preserving their cost advantage.

SUMMARY OF THE INVENTION

The ultra precision net shape forming process of this invention can satisfy MMW, sub-MMW, and small caliber sabot requirements. The process is well suited to both moderate and high volume applications, and offers the potential for dramatically reducing piece part fabrication costs. The process involves closely controlled high temperature compression forming of metals with cycle times of the order of one minute or less, precise replication of all die features, and very low residual stresses. The ultra precision net shape forming cycle starts following insertion of the blank into an open die. In the preheat phase the press is closed to preheat position where the blank is enclosed in both halves of the die but no force is applied. Following preheat the part is formed employing displacement and force control to insure a fully formed part. After holding for a preset time at the peak force, the press is then commanded back to the loading position. The process has many of the attributes of conventional compression molding of plastics and is well suited to high volume, automated production of complex precision parts.

DESCRIPTION OF THE PREFERRED EMBODIMENT(S)

Figure 1:
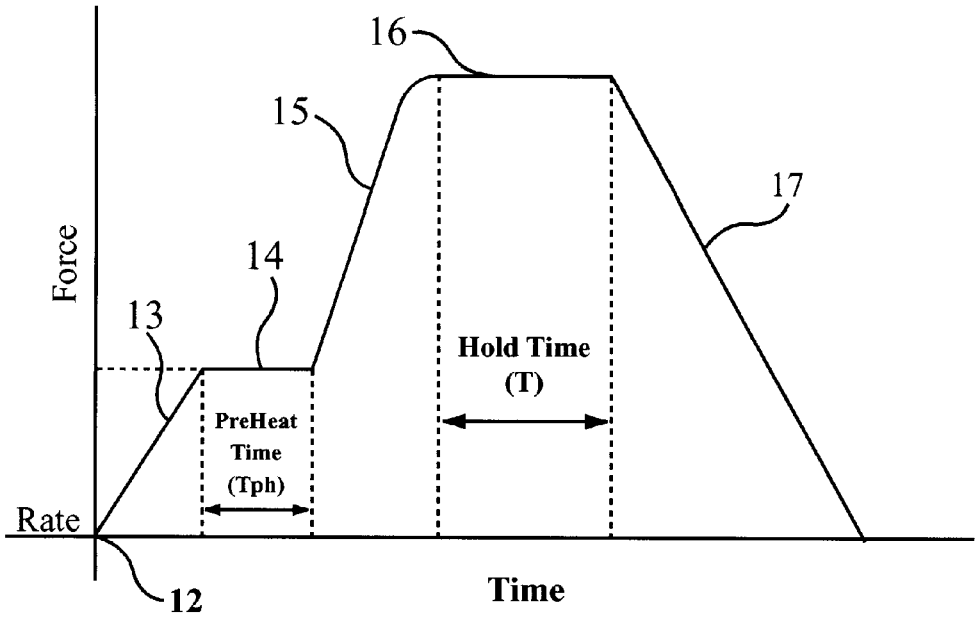
FIG. 1 illustrates the generic ultra precision net shape forming cycle.

In reference to FIG. 1 of the drawing, which illustrates the generic ultra precision net shape forming cycle, the cycle starts following insertion of the billet/blank within die member halves, in open position 12. Transitioning is achieved from open position of displacement rate 13 to preheat position 14 which is held for a preheat time. In the preheat position the press is closed where the billet/blank is enclosed within die member halves, but no force is applied. Following preheat time, transitioning is achieved from preheat position by displacement rate force control 15 to peak force position 16 where hold time temperature ($T_h$) and peak force (Fp) are maintained whereby the billet/blank is formed employing displacement and force control to ensure a fully formed part. After holding for a preset time at the peak force 16, the press is then commanded by displacement rate force open ($DR_{op}$) 17 or to the loading position.

Figure 2:
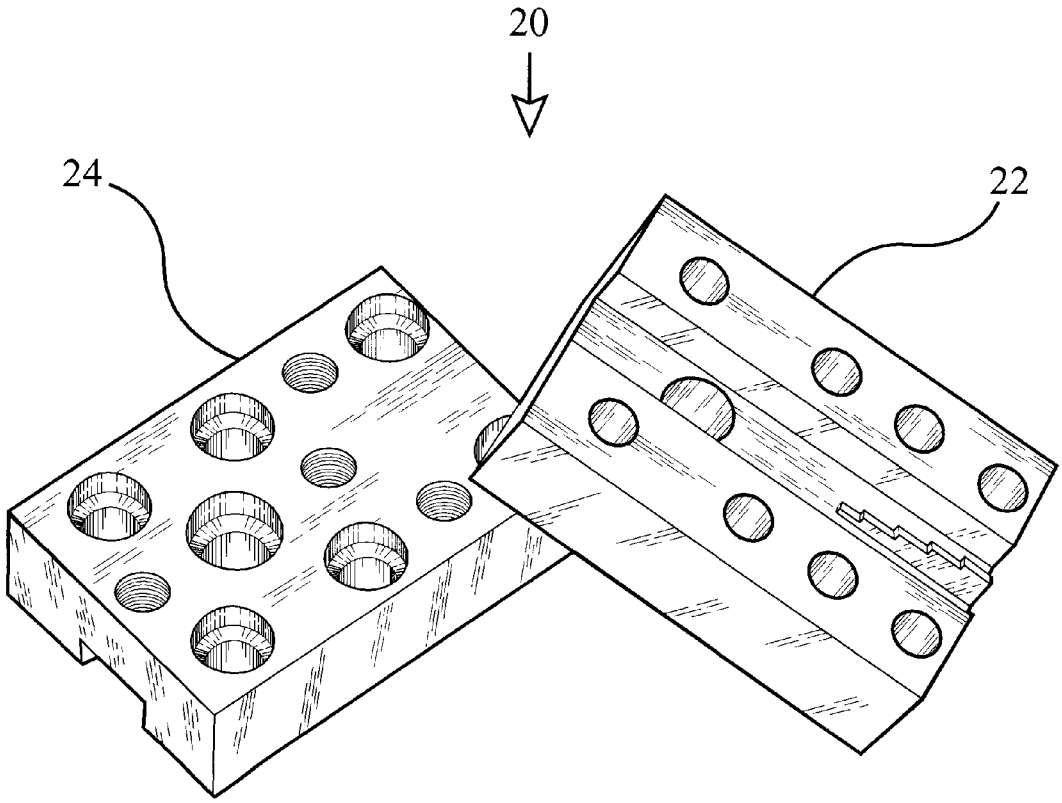
FIG. 2 shows representative MMW components fabricated using the process.

In further reference to FIG. 2, 20 represents MMW, components 22 and 24 fabricated using the process. These components are oscillator housings for use in an automobile collision avoidance radar. The dimensions of the waveguide and the tuning fin are critical to the correct functioning of this component. These components were successfully fabricated from Al 1100, Al5083 and Al6061.

Figure 3:
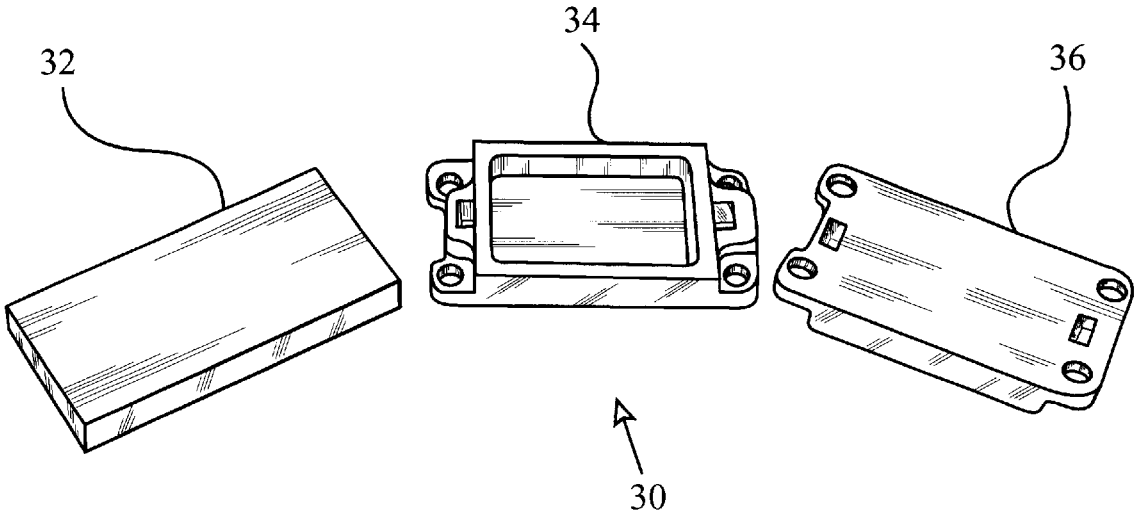
FIG. 3 depicts a blank, a front view, and a rear view of experimental power amplifier housing.
Figure 4:
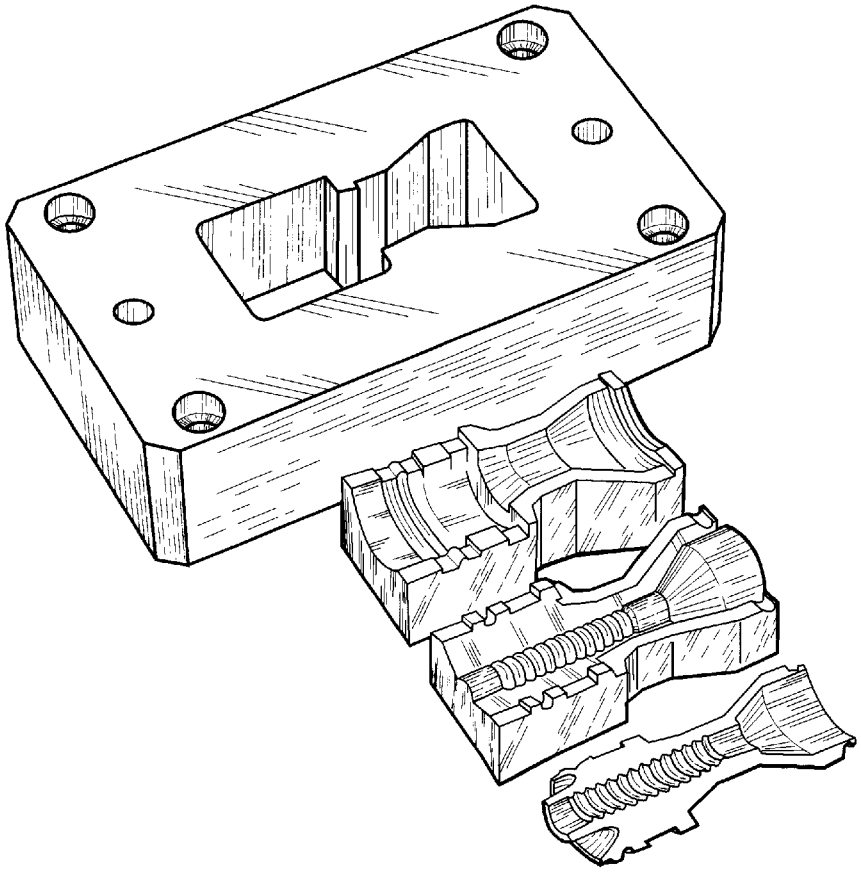
FIG. 4 shows a 25 mm sabot die. A fabricated component is shown to illustrate the component the die is to produce.

In further reference to FIG. 3, representation 30 is achieved of an experimental power amplifier housing for a missile guidance radar. Included in the representation are the blank 32 from which the power amplifier housing is formed and a front view 34 and rear view 36 of finished parts. Note the rectangular vertical waveguide on each end of the part 36. A comparisons of the blank size and the finished piece size gives an appreciation for the extent to which the material is moved during the forming process. This component was formed from A40 aluminum silicon composite material.

A central aspect of successful ultra precision forming is the ability to manage the stress and strain relationships in the material during forming. By controlled heating of the dies it is possible to maintain the material at the optimum temperature during the forming process. Close control of the press platen and die displacement over time during the forming process allows tailoring of the stresses in the material and associated movement of material into the die cavities so as to provide maximum feature fidelity.

Successful forming has been achieved with several different base materials of aluminum 41 alloys and aluminum composites. It appears that Al 1100, Al 5083 and Al 5083 (SP), Al 6001 and Al 7475(SP) are well suited to the process. The alloys with the "SP" notation are specially formulated superplastic variants of the basic alloy. Al 7075 can be formed without adversely impacting any material characteristics. Success has been achieved with A40, an aluminum silicon composite containing forty percent silicon; it is believed that the entire family of AlSiC metal matrix composites are candidates as well.

The key process attributes include:

(i.) isothermally heated dies at temperatures in the range of 80% to 95% of the melting temperature ($T_m$) of the base material;

(ii.) use of a solid material billet/blank with the volume of the blank tailored to volume of finished part thereby minimizing material wastage;

(iii.) rapid heating of the material billet/blank and maintenance at the desired forming temperature "in situ", e. g. in the forming die;

(iv.) dynamically controlled die movement with the compression force profile tailored over time to manage internal stresses during forming and minimize residual stresses in finished part;

(v.) peak forming forces in range of 15,000 to 25,000 psi;

(vi.) material stresses relatively insensitive to strain rate;

(vii.) strain rates during forming of a given piece with a range of 0.01 $sec^{-1}$ to 0.2 $sec^{-1}$;

(viii.) complete part forming times typically in the range of twenty to forty seconds; and, (ix.) the ability to form a range of materials including, but not limited to, aluminum and aluminum metal matrix composites.

Based on experience with die sets and a manual press, and the design requirements for a production prototype automated forming station, a design requirement list is recommended for the method of this invention as follows:

(i.) Press Action-Double acting press with ability to computer control both down and up stroke on ram;

(ii.) Minimum stroke—3–4 inches (need sufficient room to (eventually) auto place blanks and to eject/remove finished part;

(iii.) Press capability>100 ton;

(iv.) Nominal Die capacity (e.g. finished part maximumdimension)—50 sq. in. (e.g. 7×7, 6×8, etc.);

(v.) Maximum anticipated forming area—10 sq. in. @20 kpsi, 15 sq. in.@ 12 kpsi;

(vi.) Ram motion speed—down controllable 0 to 0.250 inch/sec. , up 0.250 inch/sec;

(vii.) Ram motion control—displacement controllable to better than or equal to 0.001 inches, force controllable in range of 100 lbs.;

(viii.) Integrated hydraulic part ejection capability—15, 000 lbs. (1000# sq. in.); and, (ix.) Quick dies change (few minutes maximum).

Die Lubricant and Die Finish Requirements

The finish of the die surfaces in as-machined condition is generally too rough to obtain good release of the parts; therefore, after initial machining, a high quality polishing technique should be completed such as achieved by ultrasonically polishing of the internal working surfaced of the die. The die should be coated with tungsten disulfide ($WS_2$) dry film lubricant available as Dicronite™. It is essential that a permanent, vapor deposited coating, 20 micro-inch thick be applied to the die parts to minimize galling. Galling is the random stripping of metal from part sidewalls as the part is ejected from the die. This is caused by failure of the lubrication between the part and the die. It is manifested as vertical striations on the sides of the finished parts. A good part should be free from galling since part function can be impaired even with minimal galling present.

We claim:

1. An ultra precision forming method employing controlled plastic deformation of metals at elevated temperatures to achieve production of components to the precision required for millimeter wavelength and sub-millimeter wavelength requirements, the method comprising the steps of:

(i.) providing a double action press with ability to be computer controlled for both down and up stroke on ram, said ram having a down controllable speed 0 to 0.250 inches/sec and an up controllable speed of 0.250 inches/sec, said double action press adapted for receiving a solid material billet/blank with the volume of the blank tailored to volume of finished part thereby minimizing material wastage, and said double action press adapted for receiving a die member comprised of two halves wherein said solid material billet/blank is enclosed in said die member halves;

(ii.) placing said die members in said double action press, said die members being ultrasonically polished on internal surfaces and sidewalls which are subsequently coated with a dry film lubricant a tungsten disulfide to prevent galling when finished part is ejected from said die members;

(iii.) inserting said solid material billet/blank within said die member halves in the open position of said double action press, said solid material billet/blank selected from aluminum alloys and aluminum composites;

(iv.) closing said double action press to preheat position where said solid material billet/blank is enclosed within said die member halves and holding at preheat displacement for a predetermined time;

(v.) isothermally heating said die member halves and said solid material billet/blank in the range of 80 percent to 95 percent of the melting point of said solid material billet/blank while holding in said preheat displacement position with no force being applied;

(vi.) transitioning from preheat displacement to force rate control and holding at a peak force for a predetermined time and at a predetermined temperature hold time to achieve forming of said material billet/blank;

(vii.) forming said billet/blank by closely controlled high temperature compression force profile tailored over time to manage internal stresses during forming and minimizing residual stresses in finished part; and, (viii.) commanding said double action press to return to loading or said open position to recover said finished part.

2. The ultra precision forming method as defined in claim 1 wherein said closely controlled high temperature compression force employs peak forming forces in range of 15,000 psi to 25,000 psi to achieve strain rates during forming of said billet/blank within a range of 0.01 $sec^{-1}$ to 0.2 $sec^{-1}$.

3. The ultra precision forming method as defined in claim 2 wherein complete part forming from said billet/blank is typically in range of twenty to forty seconds.

* * * * *